US007895691B2

(12) United States Patent
Fiebrich

(10) Patent No.: US 7,895,691 B2
(45) Date of Patent: Mar. 1, 2011

(54) INDIVIDUAL CRIB BUMPER (ROLLEY POLEYS)

(75) Inventor: Georgia Gabrielle Fiebrich, San Antonio, TX (US)

(73) Assignee: Go Mama Go Designs LLC, San Antonio, TX (US)

( * ) Notice: Subject to any disclaimer, the term of this patent is extended or adjusted under 35 U.S.C. 154(b) by 0 days.

(21) Appl. No.: 12/052,974

(22) Filed: Mar. 21, 2008

(65) Prior Publication Data

US 2009/0235453 A1 Sep. 24, 2009

(51) Int. Cl.

| | |
|---|---|
| ***A47D 15/00*** | (2006.01) |
| ***A47D 7/00*** | (2006.01) |
| ***A47D 13/06*** | (2006.01) |
| ***A47C 21/08*** | (2006.01) |

(52) U.S. Cl. ..... 5/663; 5/946; 5/424; 5/93.1

(58) Field of Classification Search ..... 5/663, 658, 5/93.1, 100, 424, 425, 946

See application file for complete search history.

(56) References Cited

U.S. PATENT DOCUMENTS

| | | | | |
|---|---|---|---|---|
| 2,203,921 | A * | 6/1940 | Padjen | 5/100 |
| 2,600,556 | A | 6/1952 | Malm | |
| 3,430,272 | A | 3/1969 | Thorn, Jr. | |
| 3,803,646 | A | 4/1974 | Newerowski | |
| 3,877,090 | A | 4/1975 | Schutz | |
| 4,670,923 | A | 6/1987 | Gabriel et al. | |
| 4,767,419 | A | 8/1988 | Fattore | |
| 4,800,600 | A | 1/1989 | Baum | |
| 4,890,346 | A | 1/1990 | Rist | |
| 5,010,611 | A | 4/1991 | Mallett | |
| 5,048,892 | A | 9/1991 | Ledbetter | |
| 5,241,718 | A | 9/1993 | Pope | |
| 5,410,765 | A | 5/1995 | Youngblood | |
| 5,421,046 | A | 6/1995 | Vande Streek | |
| 5,437,071 | A | 8/1995 | Feigenbaum | |
| 5,706,534 | A | 1/1998 | Sherman | |
| 5,926,873 | A | 7/1999 | Fountain | |
| 5,937,458 | A | 8/1999 | DeRosa | |
| 5,960,493 | A | 10/1999 | Rhey | |
| 6,055,690 | A | 5/2000 | Koenig | |
| 6,301,731 | B1 * | 10/2001 | Jakubowski et al. | 5/658 |
| 6,401,281 | B1 | 6/2002 | Younge | |
| 6,438,775 | B1 * | 8/2002 | Koenig | 5/424 |
| 6,564,403 | B1 | 5/2003 | Titus | |

(Continued)

OTHER PUBLICATIONS

Gershman, Maurice, M.D. "Self-Adhering Nylon Tapes." Journal of AMA. Oct. 18, 1958; 168:7.*

*Primary Examiner* — Robert G Santos

(74) *Attorney, Agent, or Firm* — The Marbury Law Group PLLC

(57) ABSTRACT

An individual crib rail bumper providing protective padding in and around a child's crib to increase bodily protection and to provide additional comfort, support, and aesthetic design. An individual crib rail bumper is a long, cushioned, 2-sided, rectangular shaped soft protective material that securely wraps 360 degrees around each individual crib rail by use of strategically placed fasteners. A set of individual crib bumpers offers different fabric choices on each side and is designed to accommodate any size crib rail. They can easily be applied and are simple to remove for washing. The individual vertical crib bumpers also provide critical safety features that resolve long outstanding safety hazards of the standard and widely used conventional crib bumper.

11 Claims, 6 Drawing Sheets

Figure 1:
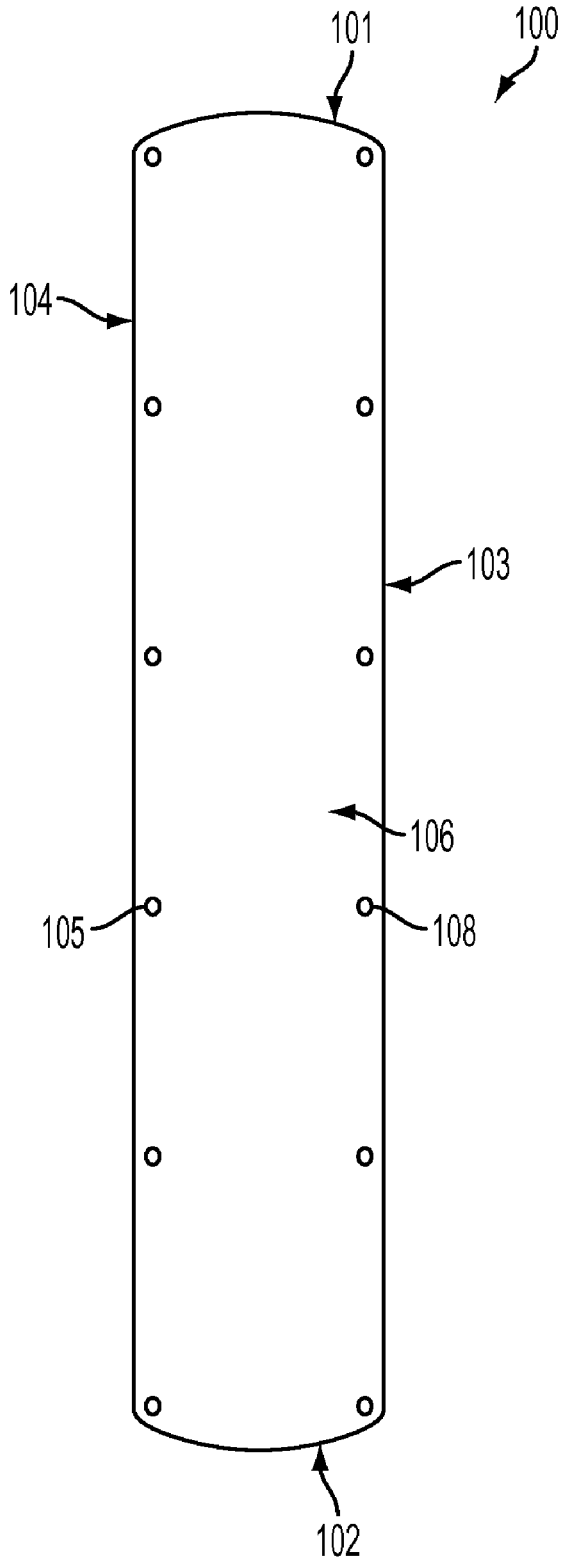

U.S. PATENT DOCUMENTS 6,574,812 B2 * 6/2003 Jakubowski et al. ..... 5/658
6,604,789 B1 8/2003 Downing
6,684,437 B2 * 2/2004 Koenig ..... 5/726
6,742,751 B1 6/2004 Demoore
6,772,457 B1 8/2004 Alaback
6,957,464 B1 10/2005 Coautte
7,055,192 B2 6/2006 Waters
D539,587 S * 4/2007 Bonal ..... D6/610
7,213,282 B1 5/2007 Wojtowiez
2002/0035753 A1 * 3/2002 Jakubowski et al. ..... 5/658
2002/0178500 A1 * 12/2002 Koenig ..... 5/424
2007/0257049 A1 * 11/2007 Tolan ..... 220/737
2009/0211023 A1 * 8/2009 Cocco et al. ..... 5/424
2009/0235453 A1 * 9/2009 Fiebrich ..... 5/424

* cited by examiner

INDIVIDUAL CRIB BUMPER (ROLLEY POLEYS)

BACKGROUND OF INVENTION

This invention relates to the field of crib bumpers and the use of protective padding in or around a child's crib to increase bodily protection and to provide additional comfort and support. Conventional bumper pads are a cushioned material that encompass the entire inside perimeter of a crib, widely used and accepted by parents and guardians to protect their child from injury in case the child would fall against the hard, wooden rails or slats. Although this invention is different than a conventional crib bumper; it has similar usage. A crib bumper serves to protect a baby from bumping and/or laying his head against the hard rails of a crib. A bumper also provides an aesthetically pleasing and soft surrounding for a newborn baby. Bumper pads are usually about 6"-12" high, normally made of 1 or 4 piece(s), and are typically fastened by strings tied around the crib rails. They also can provide a major aesthetic component of a child's bedding and room design. Although a bumper is a safety device, it is most often designed with attractive colors, fabrics, and print designs for today's consumer.

BRIEF SUMMARY OF THE INVENTION

The preferred embodiments of the present invention comprise of a long, cushioned, 2-sided, rectangular shaped soft protective material that wraps securely around each individual crib rail. The layered material most likely contains a particular density of foam, or foam-like material, between the two outer surfaces. This invention provides a soft surface for the baby's head and body and prevents any part of the hard rail from coming into contact with the baby. Because the present invention tightly wraps around the crib rail, a baby cannot use it as leverage to push its body over the crib, even when the present invention is compressed to accommodate a shorter crib rail. The present invention also allows air to circulate between the crib rails, thus reducing any unnecessary risk of SIDs.

Due to the many complications with the usage of a conventional crib bumper, there is a need for something that is more practical, safer, and can be used longer. The current design of a conventional crib bumper can actually render it useless and even dangerous because of the following: 1) a standard crib bumper is only about 6"-12" high, a baby can easily bump its head against the hard crib rails as soon as it can sit up or prop its body on all arms and legs as it learns to crawl. Once a baby can crawl or climb, it is recommended that the standard bumper be removed so that the baby cannot use the bumper as a step to hoist its body over the side of the crib. Thus, the shelf-life of an expensive bumper is only about 4 months, and once the bumper pad is removed, the crib slats are left unprotected, and so is the occupant inside. The present invention overcomes this safety issue; it can be used in the crib from the time the baby is born, until it can sleep in a regular or toddler bed (usually around 2-3 years of age; 2) the average height also prevents a newborn from looking out of the crib. Most parents would like for their babies to see what is going on around them. Neither can the parent or guardian view the child while the child is lying in the crib, unless the parent or guardian is standing next to the crib and is looking down upon the child; 3) a standard crib bumper is difficult to wash and can easily loose its shape and size after washing; 4) the conventional bumper make it extremely difficult to remove the crib sheet. Most often, one must untie or remove all four bumpers to simply remove the crib sheet for washing. The ties are cumbersome to tie and untie, plus they can be dangerous to have near a baby, and can distract from the overall aesthetic look of a bumper; 5) usage of standard crib bumpers is often discouraged due to concerns about Sudden Infant Syndrome (SIDS) because it may disrupt air circulation, especially if a baby is nestled in the corner; 6) the conventional bumpers are difficult to use when lowering the side rail of a crib to reach a child (because the bumper pad is tied to the crib rails, it moves with the rail and does not stay in one place); and 7) due to the raising and lowering of the crib rail, the ties may become loose, and potentially allow for the bumper pad to fall onto an infant who may not have the strength to push it off, thus creating a suffocation hazard.

Standard crib bumpers are a wasteful investment, and once you remove the bumper, you are still left with the cold, hard crib rails, against which your baby will now more than ever likely bump its head in its attempts to crawl. The present invention addresses the problems and disadvantages of other conventional crib bumpers by providing a safer, more practical, and longer lasting alternative.

BRIEF DESCRIPTIONS OF THE SEVERAL VIEWS OF THE DRAWING

Figure 2:
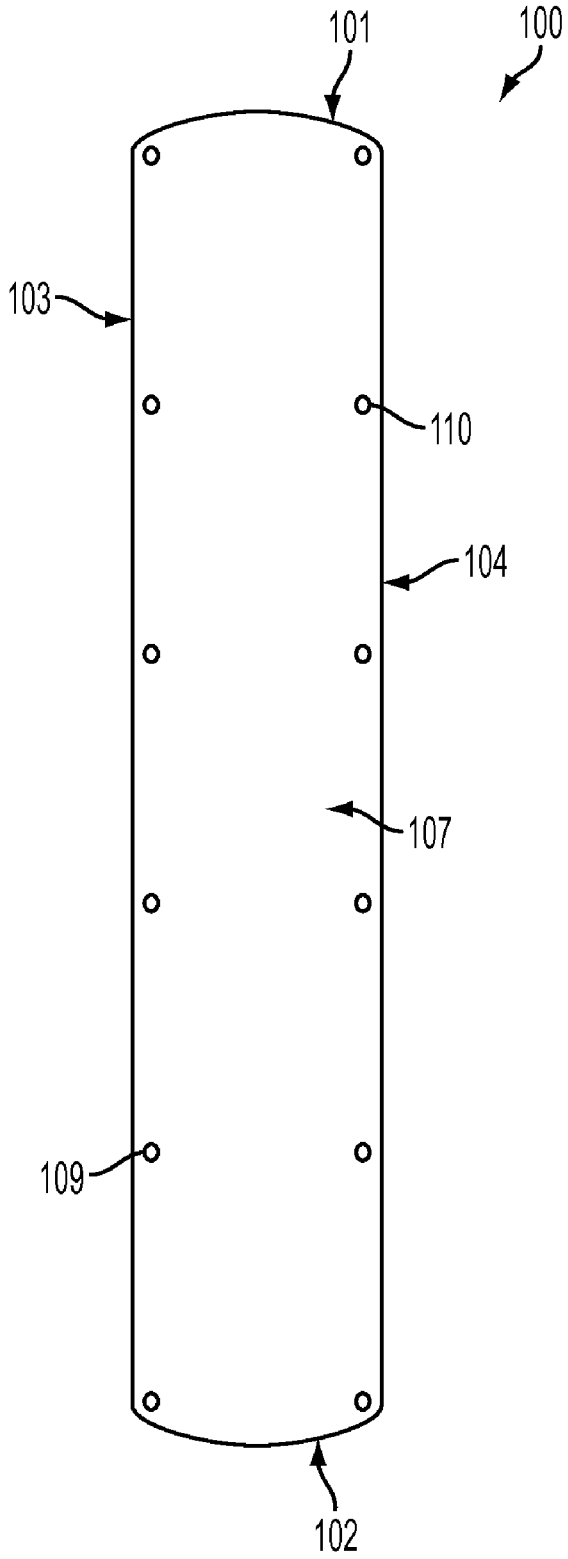
Figure 3:
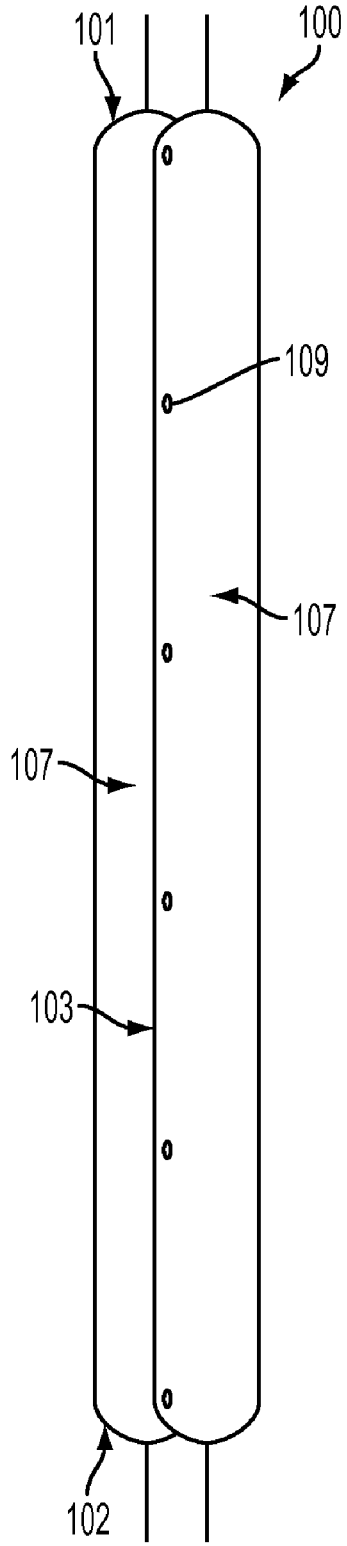
Figure 4:
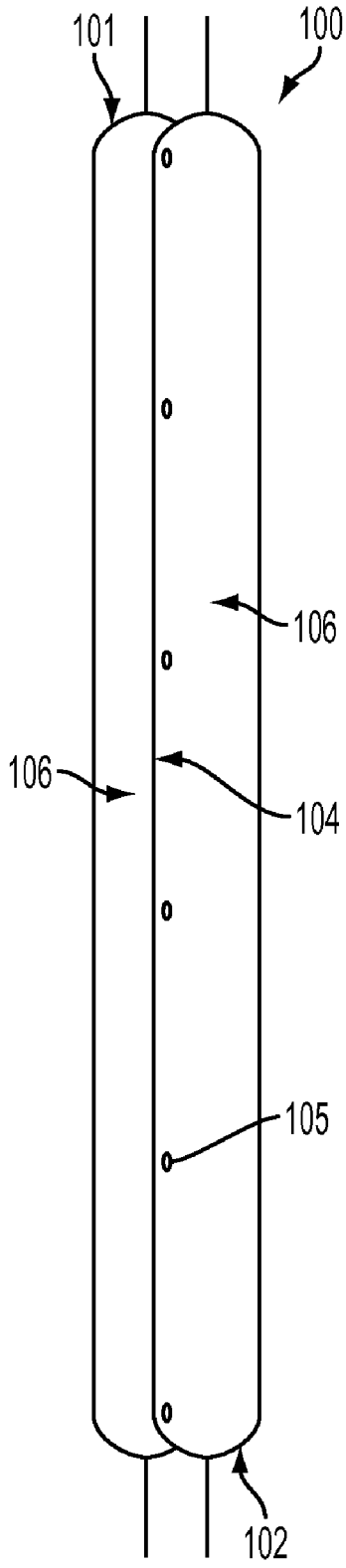
Figure 5:
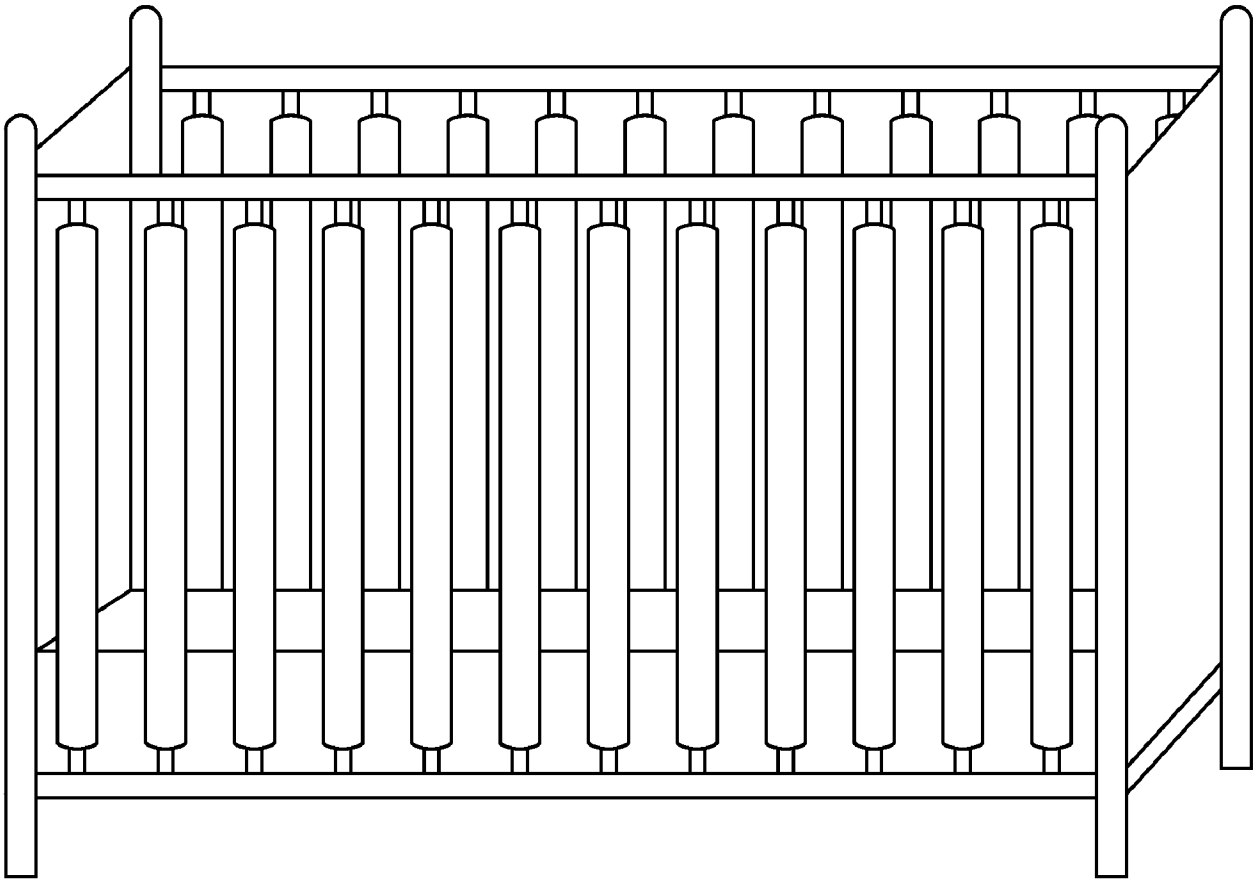
Figure 6:
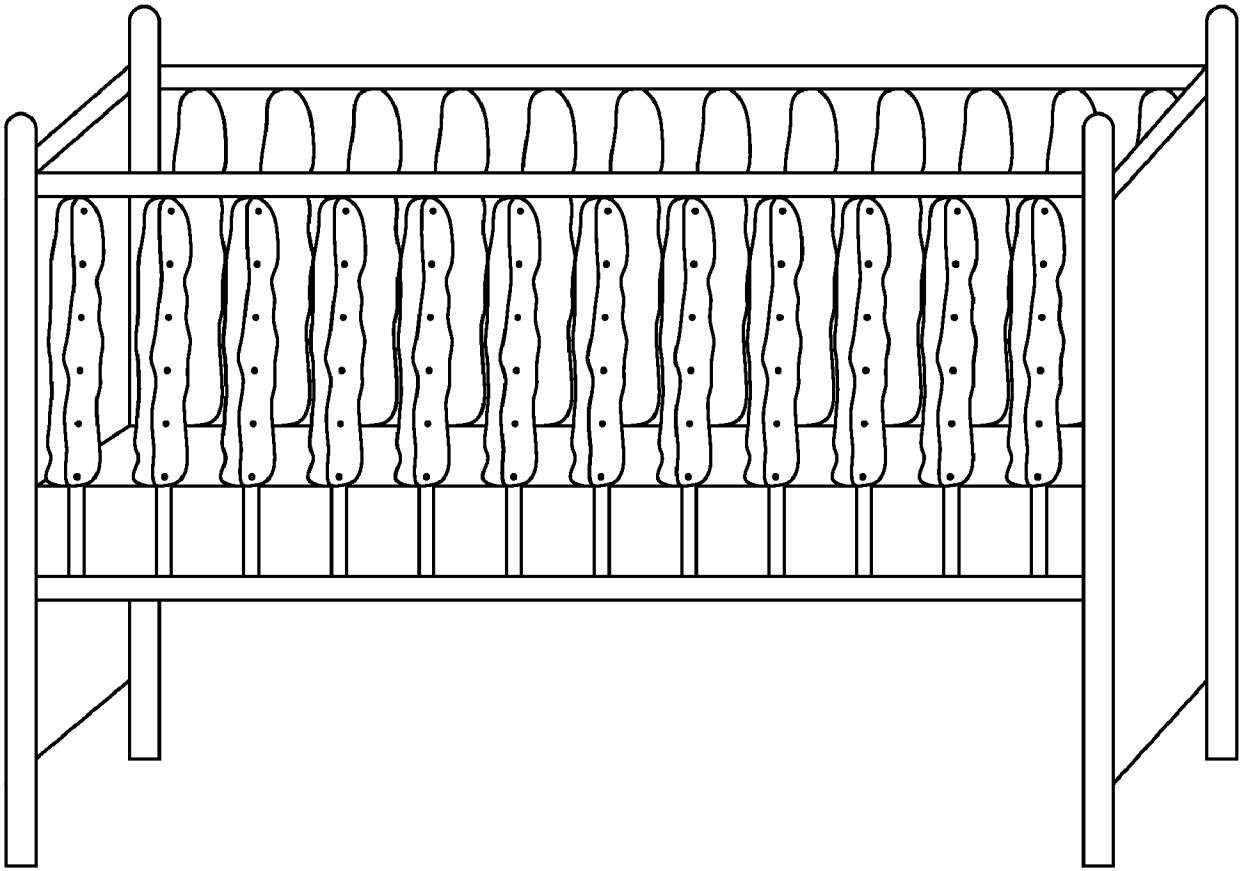

FIG. 1 is an illustrative view of the outer surface of the preferred embodiment FIG. 2 is an illustrative view of the second, outer surface of the preferred embodiment FIG. 3 is an illustrative view of the present invention in use and wrapped around an individual crib rail, and displaying one outer surface FIG. 4 is an illustrative view of the present invention in use and wrapped around an individual crib rail, and displaying the additional and reversible outer surface FIG. 5 is an illustrative view of the present invention in use and wrapped around all the individual rails of a crib, and below the top edge of the crib mattress FIG. 6 is an illustrative view of the present invention in use and compressed to wrap around all the individual rails of a crib, and above the top edge of the crib mattress with snap fasteners facing outward

DETAILED DESCRIPTION OF THE INVENTION

While researching for prior art similar to the present invention, the inventors found two patents that were more similar to the present invention than others: U.S. Pat. Nos. 5,437,071 and 6,742,751, herein known as the "prior art." These two patents, albeit making fair attempts at responding to the deficiencies of a conventional bumper, fail to accommodate the ever expanding range of styles, sizes, and shapes of cribs available on the market as of 2008. Any new and innovative design in crib bumpers must be versatile enough to be used on all or most of the various cribs available today. By ignoring this most important issue, the prior art remains useless and provides little or no help to parents who are concerned about their children's sleep environment.

U.S. Pat. No. 6,742,751 (2004), the more recent of the two patents, attempts to address important issues overlooked by U.S. Pat. No. 5,437,071 (1995), which the present invention does as well; however, U.S. Pat. No. 5,437,071 will not be addressed to such degree in this document because the inventors seek to address the disadvantages of the more recent patent U.S. Pat. No. 6,742,751. Although the present invention fully compensates for the many deficiencies of U.S. Pat. No. 5,437,071 and others, it is unnecessary to repeat such deficiencies, if U.S. Pat. No. 6,742,751 and others are reviewed. The unique design and advantages of the present invention resolve all deficiencies of both these patents and others. In addition, the preferred embodiment of the present invention provides an unprecedented design to give parents increased design options and financial savings.

The most distinguishing component of U.S. Pat. No. 6,742,751 is its biggest flaw: its rigidness and fixed vertical position. Although it claims to accommodate the various widths and shapes of crib rails, its built-in "vertical stabilizer" precludes it from ever being utilized among the hundreds of cribs whose length in crib rails varies. Without the dual option of flexibility in both width and length, a vertical crib bumper that wraps around each individual crib rail cannot respond to today's parents' needs. For example, the local baby store carries hundreds of different styled cribs with almost every crib rail being of different length. The first seven cribs encountered and surveyed by the inventors included crib rail lengths of 7", 14", 6", 13", 9", 28", and 18". Many of these cribs also contained rails of different lengths on the same crib. None of the prior art can accommodate such a wide range of lengths and still provide 360 degrees of protection around each rail. The prior art describes the typical crib rail as "usually rectangular in shape, four-sided, approximately 1" to 1.5", 0.5" thick, spaced approximately 2.375" apart, and normally 26" long." This prior art was designed to only accommodate such "typical" lengths of 26". However, as of 2008, 26" in length is now atypical and there is no longer a "typical" length in crib rails because of the enormity of style choices. The present invention's inner padding is durable enough to substantially add a protective barrier between a child's body and the hard consistency of the crib rails, but it is soft and flexible enough so that the user can elongate or shorten the present invention according to the length of the crib rail. The present invention can also be placed above or below the surface of the crib mattress, without compromising the position of the mattress or the security and placement of the present invention. This ability to accommodate all lengths of crib rails is essential to introducing a new and viable option for the parent unsatisfied with the conventional bumper and warrants the recognition of being a unique and unprecedented idea.

Equally important, a baby cannot use the present invention as leverage to push its body over the crib (even when the present invention is compressed to accommodate a shorter crib rail) because the padding is not thick or wide enough to be used by a child as a step to crawl out of the crib. In addition, the strategic placement of the snap fasteners that ensure a tight and proper fit of the present invention around the crib rail would preclude a child from using it as a support mechanism for climbing.

The strategically placed, reversible snap fasteners used to attach the crib rail bumper to itself, also provide a unique and unprecedented aesthetic, but functional, use unforeseen in prior art. The option to have different colors and types of fabric choices for both sides of a vertical crib bumper is a commercially lucrative feature that would highly satisfy consumers, but also save them money. By providing possibly two very distinct fabric choices, a parent may be able to use the bumper for multiple children, including ones of different gender. It also gives them an additional design option without having to purchase an additional bumper. The series of reversible snap fasteners also provides an easy approach to wrapping the present invention around each crib rail, unlike the prior art.

The present invention provides a standard level of protection despite the wide range of sizes and styles and resolves the many deficiencies of the conventional bumper, which is, unfortunately, used almost exclusively throughout the United States. The present invention gives parents a high standard of care while providing them with financial savings.

The present invention addresses the problems and disadvantages of other conventional crib bumpers by providing a safer, more practical, and longer lasting alternative.

The preferred embodiments of the present invention comprise of a long, cushioned, 2-sided, rectangular shaped soft protective material that wraps securely around each individual crib rail. The layered material most likely contains a particular density of foam, or foam-like material, between the two outer surfaces. This invention provides a soft surface for the baby's head and body and prevents any part of the hard rail from coming into contact with the baby. Because the present invention tightly wraps around the crib rail, a baby cannot use it as leverage to push its body over the crib, even when the present invention is compressed to accommodate a shorter crib rail. The present invention also allows air to circulate between the crib rails, thus reducing any unnecessary risk of SIDs.

The present invention is also constructed from washable, soft fabrics that are comforting and aesthetically pleasing, and can easily be removed for individual wash. Because of its sleek design and independence of any ties to secure it, it does not hinder the removal of the crib sheet or the movement of the crib when retrieving the baby. The lack of ties also makes it less dangerous and less cumbersome in its overall use. The preferred embodiment of the present invention also allows the baby to see through the crib rails.

The present invention wraps around the entire surface of each crib rail, and provides an equal amount of padding around the entire outer surface of the rail. By providing equal padding around the entire surface of the rail, one can easily attach the bumper to the rail without worrying where the most padding is located to best protect the baby. Also unlike other previous inventions, the outer surface of the preferred embodiment is reversible so that the user of this invention can utilize and appreciate the choice of two different outer fabric colors and styles. In addition, the flexibility of the materials allows the invention to be used on various sizes (both in length and width) and styles of crib rails. The growing number of different sizes, shapes, and styles of cribs must be addressed. Full use and practicality of this invention depends on its flexible, yet precise, measurements and size. Unlike previous art, the invention fits all types of crib rails. The present invention also will be sold in sets of various amounts so that the consumer only has to buy the number they need.

A preferred embodiment of the present invention is shown in FIG. 1, a crib bumper 100 that is rectangular in shape with two equal horizontal sides 101 and 102 and two equal vertical sides 103 and 104. A second outer surface 107 is located on the reverse and opposite outer side of 106 (FIG. 2) with vertical side 104 now located on the right side of outer surface 107 and vertical side 103 located on the left side.

Outer surface sides 106 and 107 share and are bound together by top side 101 and bottom side 102. They also share and are bound together by the two longer sides 103 and 104. The outer surface sides 106 and 107 of crib bumper 100 are likely to be made of different fabrics options.

Outer surface 106 contains two parallel and identical columns of snap fasteners, all of which are male (stud) components 105 and 108, as in FIG. 1. Outer surface 107 contains two parallel and identical columns of snap fasteners, all of which are female (socket) components 109 and 110, as in FIG. 2.

Snap fasteners of crib bumper 100 contained on sides 106 and 107 are strategically placed so that the male (stud) snap fasteners 105 on side 106 fit into the female (socket) snap fasteners 109 on side 107 in order to display the outer surface side 107 around the crib rail, as shown in FIG. 3. To the display the outer surface of side 106, the female (socket) snap fasteners 110 would adhere to the male components of snap fasteners 108 on side 106, as shown in FIG. 4.

FIG. 5 illustrates a set of crib bumpers 100 wrapped around the crib rails of a crib. Crib bumpers 100 are wrapped around the crib rails below the top edge of the crib mattress 99 and are expanded to show the flexibility of crib bumper 100 to accommodate a longer crib rail length. FIG. 6 illustrates that crib bumper 100 can also easily be used above the top surface of a crib mattress 99 and compressed to accommodate a shorter crib rail length.

I claim:

1. A vertical padded bumper for individual crib rails or slats, comprising:

a pad comprising a soft, flexible cushioning material and further comprising two horizontal sides, two vertical sides, a first outer surface, and a second outer surface; and reversible fasteners adjacent the two vertical sides configured to allow either of the first outer surface and the second outer surface to face outward when the bumper is fastened by the reversible fasteners to the crib rail or slat;

wherein the horizontal and vertical sides are dimensioned and the flexible cushioning material is selected to provide the pad with sufficient flexibility to secure the cushioning material of the bumper 360° around the crib rail or slat and compress or expand to substantially fit crib rails or slats having lengths between approximately 6" to 28".

2. The vertical padded bumper of claim 1, wherein the reversible fasteners are reversible snap fasteners.

3. The vertical padded bumper of claim 1, wherein the bumper further comprises fabric covering the cushioning material.

4. The vertical padded bumper of claim 3, wherein fabric covering the first outer surface has a different appearance than fabric covering the second outer surface.

5. The vertical padded bumper of claim 3, wherein the fabric is washable.

6. The vertical padded bumper of claim 1, wherein the soft, flexible cushioning material has a substantially uniform thickness.

7. The vertical padded bumper of claim 1, wherein the horizontal sides are dimensioned, the flexible cushioning material is selected, and the reversible fasteners positioned so that the bumper fits tightly around the crib rail or slat.

8. The vertical padded bumper of claim 1, wherein the pad is substantially rectangular.

9. The vertical padded bumper of claim 1, wherein the reversible fasteners provide a first configuration which displays the first outer surface and a second configuration which displays the second outer surface.

10. A set of vertical padded bumpers for individual crib rails or slats comprising a plurality of vertical padded bumpers, each of the plurality of vertical padded bumpers comprising:

a pad comprising a soft, flexible cushioning material and further comprising two horizontal sides, two vertical sides, a first outer surface, and a second outer surface; and reversible fasteners adjacent the two vertical sides configured to allow either of the first outer surface and the second outer surface to face outward when the bumper is fastened by the reversible fasteners to the crib rail or slat;

wherein the horizontal and vertical sides are dimensioned and the flexible cushioning material is selected to provide the pad with sufficient flexibility to secure the cushioning material of the bumper 360° around the crib rail or slat and compress or expand to substantially fit crib rails or slats having lengths between approximately 6" to 28".

11. The set of vertical padded bumpers for individual crib rails or slats of claim 10, wherein each vertical padded bumper is substantially identical in size.

* * * * *

UNITED STATES PATENT AND TRADEMARK OFFICE

CERTIFICATE OF CORRECTION

PATENT NO. : 7,895,691 B2
APPLICATION NO. : 12/052974
DATED : March 1, 2011
INVENTOR(S) : Georgia Gabrielle Fiebrich and Catherine Nora Hall It is certified that error appears in the above-identified patent and that said Letters Patent is hereby corrected as shown below:

Title Page, Item (54) and at Column 1, lines 1 and 2, title,
"Individual Crib Bumper (Rolley Poleys)", should read --Individual Crib Rail Bumpers--.

Title Page, Item (75) Inventors: should read --Georgia Gabrielle Fiebrich, San Antonio, TX (US); Catherine Nora Hall, Castlerock, CO (US).--.

Signed and Sealed this
Third Day of May, 2011

David J. Kappos

David J. Kappos
*Director of the United States Patent and Trademark Office*